US006968945B2

(12) United States Patent
Bruins et al.

(10) Patent No.: US 6,968,945 B2
(45) Date of Patent: Nov. 29, 2005

(54) CAP ASSEMBLY AND CAP FOR AUTOMATIC FASTENER DRIVER

(75) Inventors: Roger C. Bruins, Grand Rapids, MI (US); Roger A. Vanden Berg, Grand Rapids, MI (US)

(73) Assignee: National Nail Corp., Grand Rapids, MI (US)

( * ) Notice: Subject to any disclaimer, the term of this patent is extended or adjusted under 35 U.S.C. 154(b) by 0 days.

(21) Appl. No.: 10/890,027

(22) Filed: Jul. 13, 2004

(65) Prior Publication Data

US 2005/0000835 A1 Jan. 6, 2005

Related U.S. Application Data

(62) Division of application No. 09/789,305, filed on Feb. 20, 2001, now Pat. No. 6,779,700.

(60) Provisional application No. 60/183,402, filed on Feb. 18, 2000.

(51) Int. Cl.[7] ..... B65D 85/24
(52) U.S. Cl. ..... 206/338; 206/345; 206/820
(58) Field of Search ..... 206/338, 343, 206/345, 820; 227/120, 136; 411/442–445, 411/500–510, 531, 542, 544; 221/232

(56) References Cited

U.S. PATENT DOCUMENTS 1,579,487 A 4/1926 Polinsky
1,615,276 A 1/1927 Hudson
2,009,580 A 7/1935 Govanus
2,575,455 A 11/1951 Lang
2,667,639 A 2/1954 Schick
2,908,908 A 10/1959 Steinmetz et al.
2,922,162 A 1/1960 Cohn
3,100,307 A 8/1963 Hatherell et al.
3,319,864 A 5/1967 Adams
3,353,737 A 11/1967 Howard et al.
3,385,498 A 5/1968 Downie
3,589,957 A 6/1971 Cohn
3,595,460 A 7/1971 Pitkin
3,708,062 A 1/1973 Feldheim et al.
3,727,821 A 4/1973 Pabich et al.
3,734,377 A 5/1973 Munn
3,741,455 A 6/1973 Wandel et al.
3,796,365 A 3/1974 Downing
3,826,419 A 7/1974 Maestri
3,854,190 A 12/1974 Stark
3,854,648 A 12/1974 Inzoli et al.
3,915,367 A 10/1975 Potucek
3,930,297 A 1/1976 Potucek et al.
3,935,983 A 2/1976 Buttriss
3,945,549 A 3/1976 Colson
3,966,042 A 6/1976 Shelton et al.
3,971,421 A 7/1976 Damratowski
4,014,488 A * 3/1977 Potucek et al. ..... 227/136

(Continued)

*Primary Examiner*—Bryon P. Gehman
(74) *Attorney, Agent, or Firm*—Warner Norcross & Judd

(57) ABSTRACT

A cap assembly for an automatic cap feeder and fastener driver comprises a plurality of relatively thin, domed metal discs that can be pierced by fasteners discharged from a fastener driver such as a nail gun without bending the nail or jamming the driver, with the caps being connected together by a paper backed adhesive tape mounted on the undersides of the concave caps, with the caps having outer edges that are sufficiently sharp that they sever the tape from the strip of caps when the caps are driven into a substrate after a fastener has penetrated the caps. The fastener driver includes improved feeder teeth and an anti-backup pawl that extend into recesses in the track. A cover encloses an open edge of a cap storage basket.

22 Claims, 13 Drawing Sheets

U.S. PATENT DOCUMENTS 4,033,499 A 7/1977 Butler
4,036,422 A 7/1977 Harvey
4,089,099 A 5/1978 Nivet
4,091,850 A 5/1978 Kjolsrud
4,098,171 A 7/1978 Haytayan
4,227,637 A 10/1980 Haytayan
4,246,939 A 1/1981 Boegel
4,309,787 A 1/1982 Lapohn
4,339,065 A 7/1982 Haytayan
4,346,831 A 8/1982 Haytayan
4,433,782 A * 2/1984 Figge et al. ..... 227/120
4,581,964 A 4/1986 Takatsuru
4,630,766 A 12/1986 Steeves et al.
4,657,167 A 4/1987 Mays
4,729,164 A 3/1988 Steeves
4,782,989 A 11/1988 Wallin et al.
4,795,074 A 1/1989 Francis
4,817,275 A 4/1989 Van Berkel
4,824,003 A 4/1989 Almeras et al.
4,867,364 A 9/1989 Wallin et al.
4,870,750 A 10/1989 Zahn
4,890,968 A 1/1990 Beach et al.
4,932,580 A 6/1990 Pfister et al.
4,954,208 A * 9/1990 Hamisch et al. ..... 156/577
4,998,662 A 3/1991 Hasan et al.
5,014,896 A 5/1991 Reitmeier et al.
5,042,142 A 8/1991 Beach et al.
5,056,684 A 10/1991 Beach et al.
5,067,865 A 11/1991 Zylka et al.
5,105,980 A 4/1992 Hofmann
5,163,580 A 11/1992 Beach et al.
5,184,752 A 2/1993 Zylka et al.
5,255,485 A 10/1993 Lemke et al.
5,267,682 A 12/1993 Okouchi
5,292,048 A 3/1994 Vanderwiel
5,312,022 A 5/1994 Thompson et al.
5,322,189 A 6/1994 Oda
5,327,645 A 7/1994 Bromley et al.
5,339,983 A 8/1994 Caple
5,347,707 A 9/1994 Beach
5,379,513 A 1/1995 Thompson et al.
5,402,695 A 4/1995 Hornung
5,445,297 A 8/1995 Beach et al.
5,484,094 A 1/1996 Gupta
5,555,780 A 9/1996 Beach et al.
5,570,618 A 11/1996 Habermehl et al.
5,584,415 A 12/1996 Beach et al.
5,634,583 A 6/1997 McGuinness et al.
5,673,816 A 10/1997 Larson et al.
5,706,708 A 1/1998 Refalo et al.
5,715,985 A 2/1998 Letson
5,947,362 A * 9/1999 Omli ..... 227/120
6,010,291 A * 1/2000 Schwingle ..... 411/442
6,109,474 A * 8/2000 Haugen ..... 221/71
6,145,725 A * 11/2000 Omli ..... 227/120
6,302,310 B1 * 10/2001 Lamb ..... 227/120
6,478,209 B1 * 11/2002 Bruins et al. ..... 227/136
6,736,303 B2 * 5/2004 Bruins et al. ..... 227/99
6,779,700 B2 * 8/2004 Bruins et al. ..... 227/136

* cited by examiner

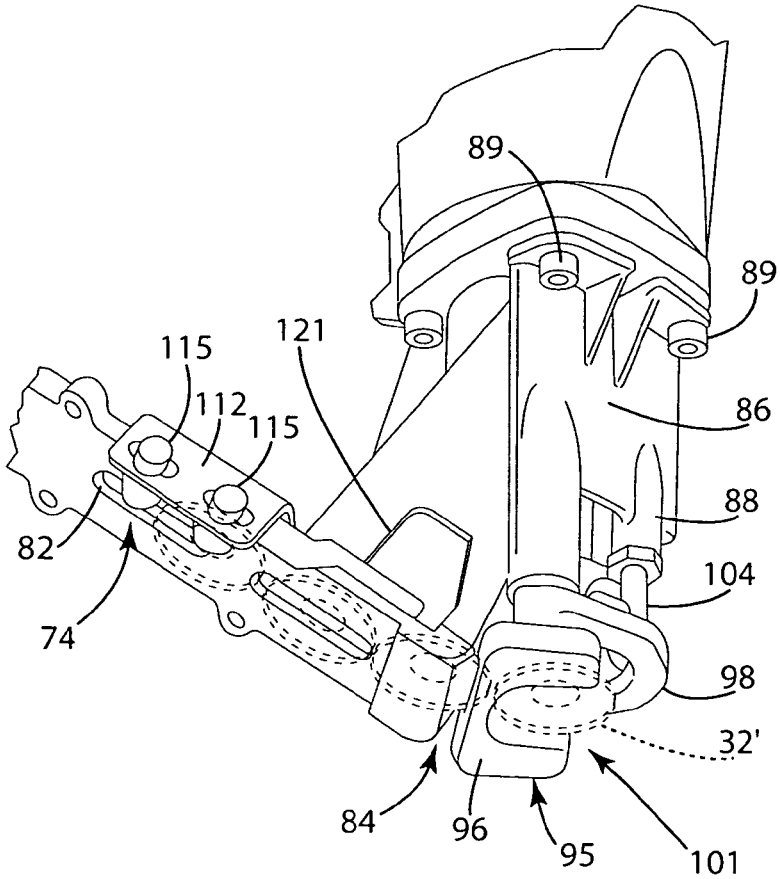
Fig. 6
Fig. 7
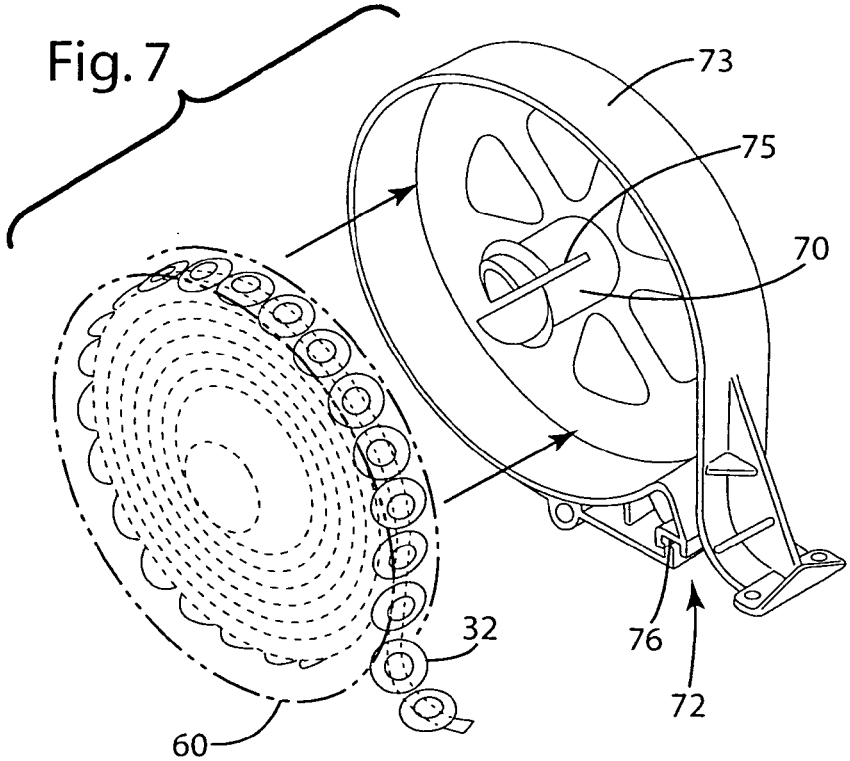

CAP ASSEMBLY AND CAP FOR AUTOMATIC FASTENER DRIVER

CROSS-REFERENCES TO RELATED APPLICATIONS

"This is a division of application Ser. No. 09/789,305, filed Feb. 20, 2001, (now U.S. Pat. No. 6,779,700)," claiming the benefit of U.S. Provisional Patent Application Ser. No. 60/183,402, filed on Feb. 18, 2000.

STATEMENT REGARDING FEDERALLY SPONSORED RESEARCH OR DEVELOPMENT

Not Applicable.

BACKGROUND OF THE INVENTION

Automatic fastener drivers such as nail guns are well known. In a typical nail gun a pneumatic or otherwise powered driver actuated by a trigger mechanism drives nails from a coil of collated nails into a substrate.

When a sheet material or a layer of foam insulation is to be attached to the substrate, it is a common practice to employ a washer or cap with the nail or fastener. The washer or cap (which will be called a cap herein) has a larger diameter than the head of the fastener and is typically formed of a resilient material in a domed or concave shape, with the concave side of the cap facing toward the substrate. The outer edges of the cap resiliently grip the substrate material over a larger area than the fastener alone. When caps are used with fasteners, in the past it has been the practice to attach the fasteners by hand. Applicant has developed an automatic cap feeder that feeds a string of collated caps into alignment with a fastener driver so that the fastener is driven through the cap and carries the cap downwardly into contact with the substrate each time a fastener is driven. Applicant's copending patent application, Ser. No. 09/380,871, filed Feb. 9, 1999, which corresponds substantially with applicant's published PCT Application, International Publication No. WO99/39878, which is incorporated herein by reference, describes a preferred tool and cap feeder. Omli U.S. Pat. No. 5,947,362 also describes a cap feeder for a fastener driver.

In most applications, the cap is an injection-molded cap formed of a synthetic resin, such as high density polyethylene. When a nail is driven through a cap, the concave surface of the cap deflects resiliently to provide a resilient gripping outer edge that engages the substrate material. These caps have holes in the centers thereof for receiving nails. However, the holes are not essential, because the fasteners are metal and are able to pierce the caps even if they are not centered on the holes, which regularly occurs. It does not affect the functionality of the caps if the nails are somewhat off center.

When plastic caps are employed, as disclosed in the cited patent application, the plastic caps are held together edge to edge by a plastic tape that extends over the tops of the caps, with the caps then being wound on a reel with the concave sides of the caps facing inwardly.

The type of tape used to hold the caps together is important. A polyester tape coated with a silicone pressure sensitive adhesive, known as composite bonding tape, is preferred for plastic caps. This tape must have sufficient gripping power to stay attached to rather slippery plastic caps over a wide range of temperature variation. The tape also has to have a low level of elongation before it breaks and must be subject to tearing where a fastener penetrates the tape. The tape selected for the plastic caps is sufficiently strong that caps can be pushed along the slide track into a dispensing location without the tape breaking. However, when a nail or the like pierces the tape, the tape must easily tear and separate at that location. The caps are driven downwardly into the substrate via the nail when a nail is employed as the fastener, and the downward movement of the cap peels the tape off the cap and permits the tape to tear at the location where the nail has penetrated the tape. It is important that the tape be on the tops of the caps for this purpose so the tape will peel upwardly off the caps. Also when the tape is on the tops of the caps and the caps are coiled with the concave surfaces facing inwardly, more caps can be wound on a reel, and the caps are restrained from being peeled off the tape until they are dispensed.

Other possible ways for attaching caps together include molding the caps together in a strip, with a thin, breakable link extending between the caps; and molding the caps with a filament in the mold, by a process known as string collation. These processes are disclosed in more detail in applicant's co-pending application.

In addition to plastic caps, it is desirable to be able to employ a metal cap with an automatic fastener driver. This presents substantial additional concerns, however. A metal cap has substantially different characteristics than a polyethylene cap, including resistance to fastener penetration and differing cling characteristics with adhesive tapes. If a metal cap is formed of a hard metal, for example, and the nail is not aligned with the hole in the cap, the nail may not penetrate the cap and it may cause the gun to jam and could damage the gun. Also, the tape must cling during normal temperature ranges and permit the caps to become separated when they are driven. The conventional tapes used for plastic caps are not ideal for metal caps.

An object of the present invention is to develop a collated cap assembly employing metal caps that can be employed in the same cap feeder apparatus as the plastic cap assemblies. Another object is to provide an improved cap feeder that more effectively feeds metal and plastic caps.

SUMMARY OF THE INVENTION

In accordance with the present invention, a cap assembly for an automatic cap feeder and fastener driver comprises a plurality of relatively thin metal discs that can be pierced by the fastener of a fastener driver such as a nail gun without damaging the nail or the gun, with the caps being connected together by a paper backed adhesive tape mounted on the undersides of the concave caps, with the caps having outer edges that cause the tape to be severed from the strip of caps when the caps are driven into a substrate after a nail has penetrated the caps.

In the preferred practice of the present invention, the caps are formed of a thin cold rolled steel having relatively sharp cutting peripheral edges with any burred edge facing up. Preferably, two sided galvanized steel is employed. The caps conventionally are approximately one inch in diameter and preferably are no greater than about 0.018 inches thick, desirably between 0.012 and 0.016 inches thick, and more preferably about 0.013 inches thick. The caps may have holes but do not require holes because the fasteners can be driven through the surface of the caps without a hole. Other metals such as aluminum or other steel can work as long as they can be pierced with the selected nail without bending the nail. The caps have a domed concave shape that enhances the peripheral gripping capabilities of the caps.

The preferred tape of the present invention is a paper backed tape coated on one side with a pressure sensitive rubber adhesive. Any substantial equivalent is satisfactory. This tape is similar in characteristics to masking tape. The preferred tape desirably is about ⅜ inch wide and has a backing material 2 mils thick and an adhesive coating 3 mils thick. The tape dimensions can be varied, as long as the tensile strength of the tape is sufficient to permit the caps to be fed without tape breakage. Also the width of the tape is less than the width of the caps and the tape is positioned inside the edges of the caps, so that the caps will completely sever the tape when they are dispensed by a fastener driver.

An important feature of the tape is that it can be severed more easily under an impact load than a polyester tape (which tends to stretch more readily), and it is not necessary to first pierce the tape in order to create a weakened area where a stress tear will propagate. Polyester tape, particularly when applied to the tops of the caps, is undesirable because the sharp, upwardly facing burred edge on the metal caps tends to cut the tape.

With the caps of the present invention, the caps can be substituted easily for plastic caps in applicant's automatic cap feeder and the caps themselves will sever the tape connecting the caps to the other caps as they are driven. The tape is then positioned under each cap and does not remain stuck to the outer surface of the cap, where it may be undesirable for aesthetic or functional purposes. Cap spacing is not too important with the use of paper backed tape positioned under the caps. A spacing of 0.050 of an inch is satisfactory.

The present invention also includes improvements in the cap feeding mechanism that facilitate feeding of metal and plastic caps with the same feeder. A new cover for a cap storage basket also is shown.

These and other features and advantages of the present invention are described in detail below and shown in the appended drawings.

BRIEF DESCRIPTION OF THE OF THE DRAWINGS

FIG. 1 is a schematic side view of an automatic nail gun and cap feeder of the type in which the cap assembly of the present invention is employed.

FIG. 2*a* is a plan view of the apparatus of FIG. 1. FIGS. 2*b* and 2*c* are alternative views showing different placements of the cap feeder and nail magazine of the nail gun.

FIG. 6 is a fragmentary perspective view taken from the lower left side of the cap slide track and nail driver of the tool of FIG. 4.

FIG. 7 is a perspective view of a reel of caps and a reel holder of the present invention.

DETAILED DESCRIPTION OF THE INVENTION

Figure 1:
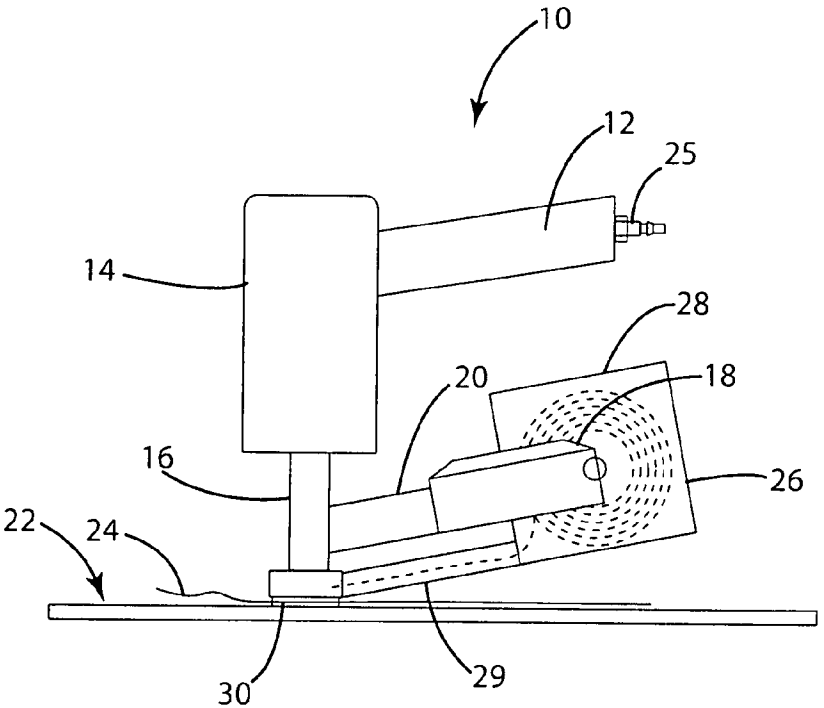

Referring now to the drawings, a conventional nail gun 10 shown schematically in FIG. 1 comprises a handle 12, a body or a housing 14 that houses a pneumatic drive cylinder, and a nail driver 16, which reciprocates vertically to drive nails. Nails are stored in a nail magazine or basket 18 adjacent driver 16 and are fed through a passage or track 20 into axial alignment with driver 16. When a nail is positioned in driving position and a trigger on the gun is actuated (and a safety is retracted) driver 16 reciprocates and drives a nail into a substrate 22, which may be covered by foam board insulation or roofing felt 24 or the like. Pressurized air is supplied to the gun through fitting 25.

In applicant's cap feeder, as described in the above referenced patent application, a cap magazine or basket 26 positioned adjacent the nail basket 18 houses a plurality of caps 32 on a spool or reel 28. The caps are connected edge to edge and fed in a line along a cap slide track 29 to a foot mechanism 30 positioned below driver 16 and nail track 20. A cap feeder synchronized with the nail driver feeds the caps into alignment with the nail driver such that when the driver is reciprocated, it first engages a nail and then causes the nail to be driven through the cap and then the nail and cap are driven into the substrate.

Figure 2A:
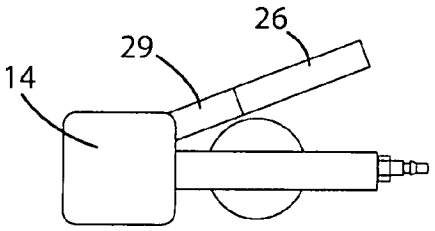
Figure 2B:
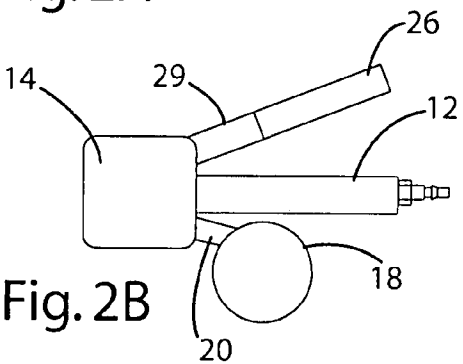
Figure 2C:
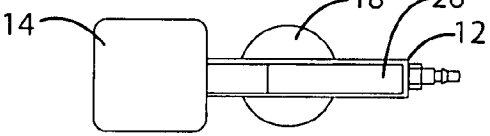
Figure 3:
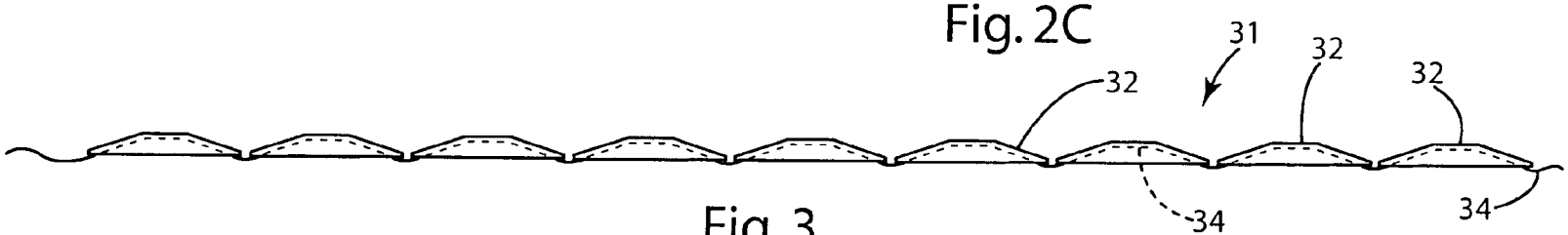
FIG. 3 is a schematic side view showing a plurality of concave caps connected together edge to edge by means of an adhesive tape attached to the bottoms of the caps.

As shown in FIGS. 2*a*–2*c*, the cap feed mechanism may be to one side of an aligned handle and nail feeder (FIG. 2*a*); or the nail feeder and cap feeder may be on opposite sides of the handle (FIG. 2*b*); or all three may be in alignment (FIG. 2*c*).

The details of the preferred embodiment of applicant's cap feeder are set forth in the subject patent application, which is incorporated herein by reference. One embodiment of the invention is shown in more detail in FIGS. 4–7.

As shown in FIG. 7, the cap holder comprises a round housing 73 having an open interior and an open side in which a spool 60 of caps is inserted. The housing has a spindle 70 that holds the spool (which alternatively is called a reel). This spindle is formed of a hollow, resilient material and has a slot 75 in the side, so that the spool can be clipped on the spindle and then removed from the spindle by squeezing the sides of the spindle together. The caps are wrapped on the spool so that the spool is rotated in a clockwise direction (FIG. 7 orientation) in order to remove caps from the top of the spool from an outlet passage 72.

Figure 4:
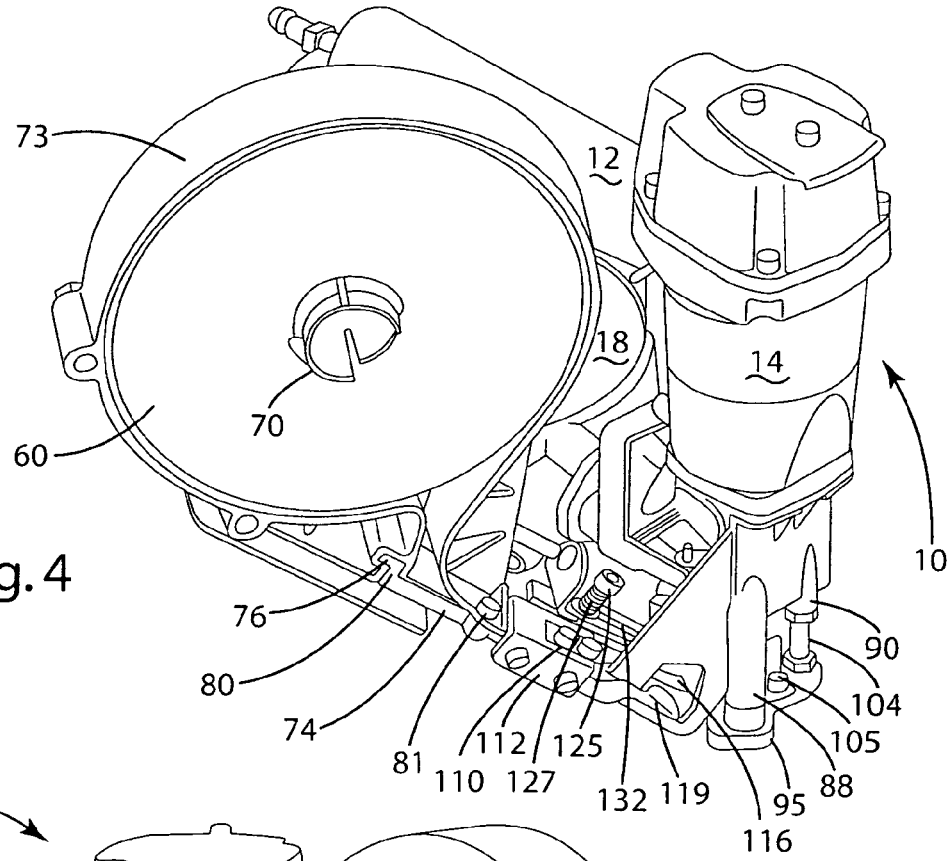
FIG. 4 is a perspective view of one embodiment a nail gun that employs the cap assembly of the present invention.

A cap slide track 74 (FIGS. 5 and 6) clips in an L-shaped opening 76 behind outlet opening 72 in the cap holder and is held in place by fasteners 81 (FIG. 4). Slide track 74 comprises an elongated flat track with raised side edges. An L-shaped connector 80 at an upper end of the track mates with opening 76 in the cap holder. The track has openings 82 in the bottom thereof which permit manual access to the caps in the track in the event of malfunction or the like. An outlet end 84 of the track discharges caps at a position adjacent the nail driver. A mounting flange 86 (FIG. 6) attaches the track to the housing 14 of the nail gun by bolts 89. The flange positions the track in proper position. Tubular members 88 and 90 in mounting bracket 86 are positioned adjacent the outer ends of the track and slidably receive a foot mechanism 95 as shown in FIG. 6.

Foot mechanism 95 comprises a lower rear member 96 and an upper front bar 98 which together encircle an open center area 101 through which nails are driven. A pair of pins 104 extends upwardly from the foot and slide up and down in mating openings in the tubular members 88 and 90. Foot 95 also moves a movable safety bracket 105 (see FIG. 4) as the foot is slid upwardly to its uppermost position. When the nail gun is placed against a substrate, and pressed downwardly, foot 95 slides upwardly. This moves safety bracket 105 upwardly until it activates the trigger of the nail gun. Then, when the trigger is pulled, the piston drives a nail downwardly into the substrate. The safety valve is conventional. It ensures that a nail cannot be driven until the foot of the gun is safely positioned against a substrate.

The bottom side of foot 95 is positioned so that when the foot is raised to an activated position, the bottom of the foot is about ⅛ to 7⁄16 inches and preferably about 5⁄16 inches below the bottom surface of the cap 32' in the discharge position. Thus, when the nail driver drives the nail through the cap and drives the nail into the substrate, the cap is displaced vertically before it contacts the substrate. This causes the sharp outer edge of the cap to sever the tape and release the cap from the other caps in the strip.

Figure 10:
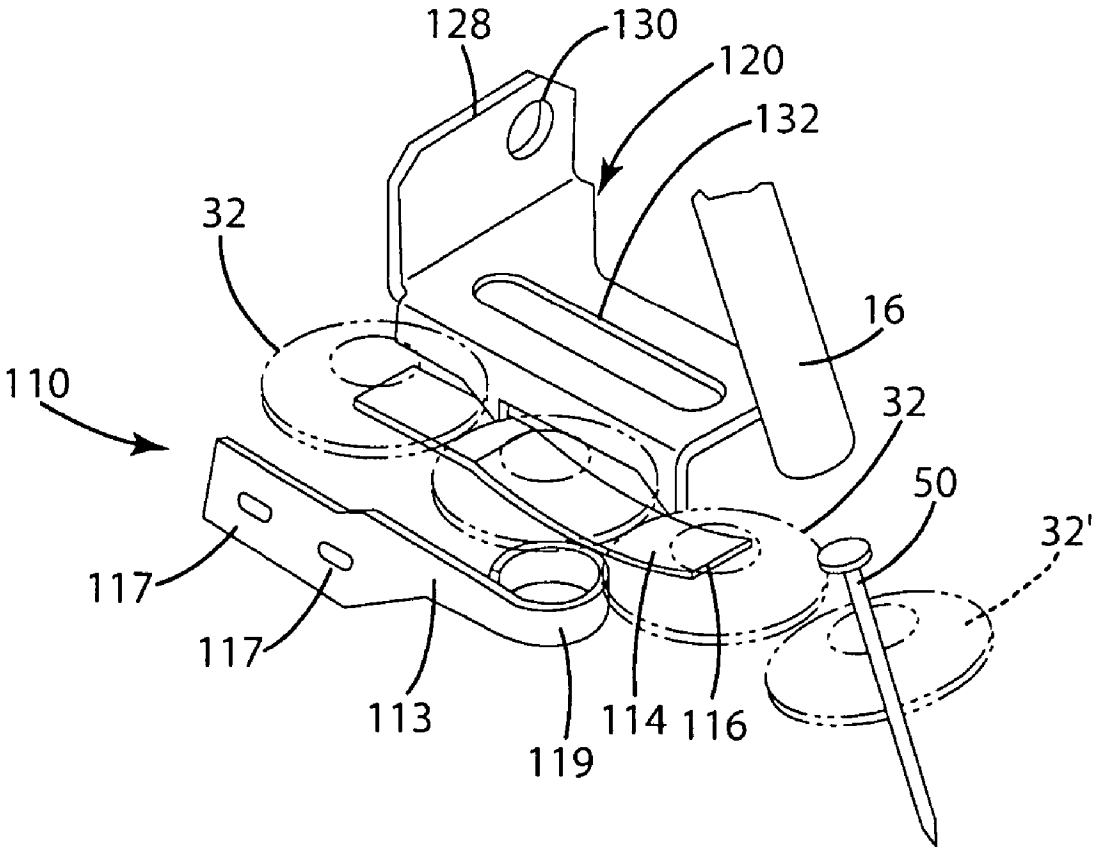
FIG. 10 is a perspective component view showing the cap pusher advancing the caps into alignment with the nail driver and showing a cap retainer and a cap locator mechanism.

A cap retainer 110, shown in FIGS. 4 and 10, is mounted on track 74 by a mounting flange 112. An elongated spring arm 114 having an upwardly tilted front end 116 is positioned over the caps in the track to hold the caps down as they move along the track. The upwardly inclined front end permits the cap path to change from an initially inclined path to a horizontal path as the caps enter the foot assembly.

The cap feed mechanism of this embodiment also includes a cap locator in the form of an indexing spring 113 that is attached to flange 112 of retainer 110 by screws 115 or the like that extend through slotted openings in the flange and into the side of the slide track. The spring 113 (FIG. 10) can have slotted openings 117 that permit longitudinal adjustment of the spring. The spring 113 has a looped head 119 that fits through an opening 121 in the bracket 86 for the slide track and into engagement between adjacent caps in order to hold the caps in a desired longitudinal position. The spring 113 is deflected out of the way in order to permit the caps to be pushed into alignment with the nail driver.

Figure 11:
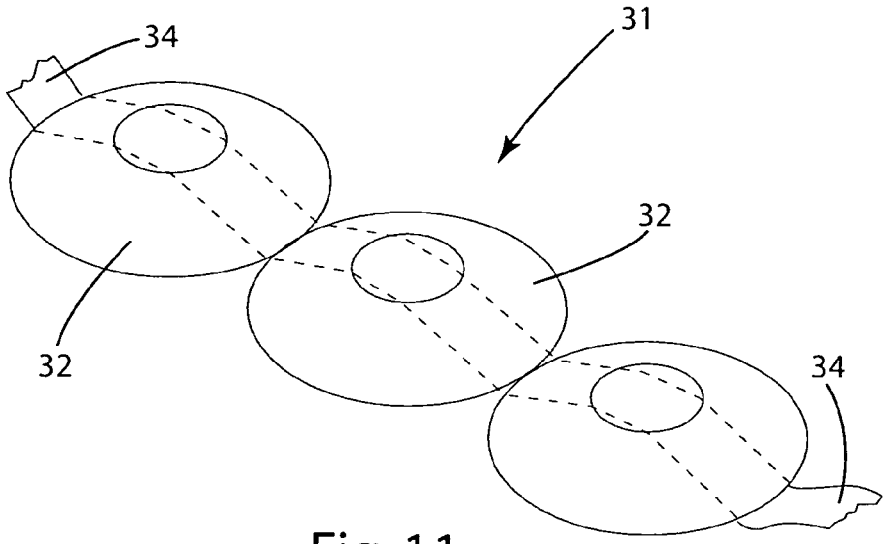
FIG. 11 is a perspective view showing a strip of caps in accordance with the present invention.
Figure 12:
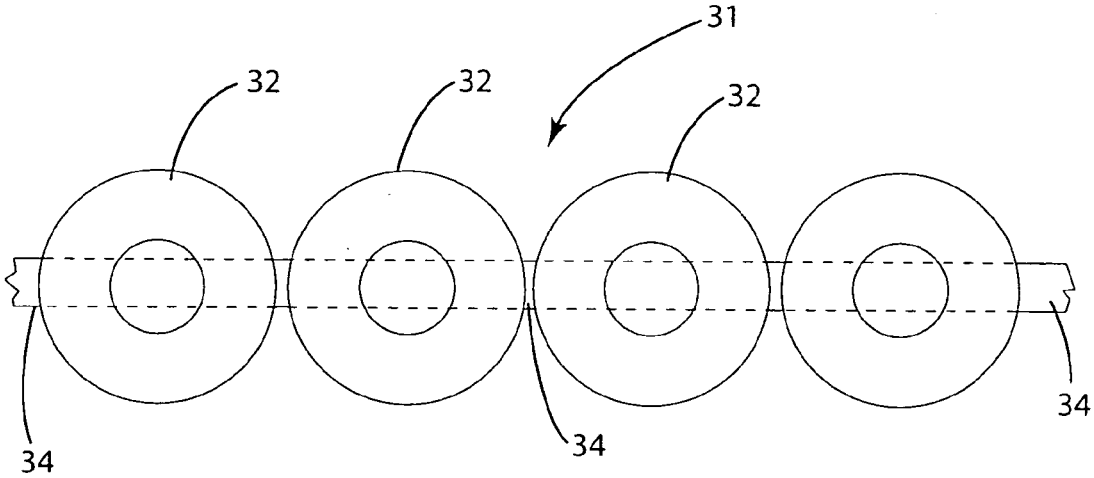
FIG. 12 is a plan view showing a strip of caps in accordance with the present invention.
Figure 13:
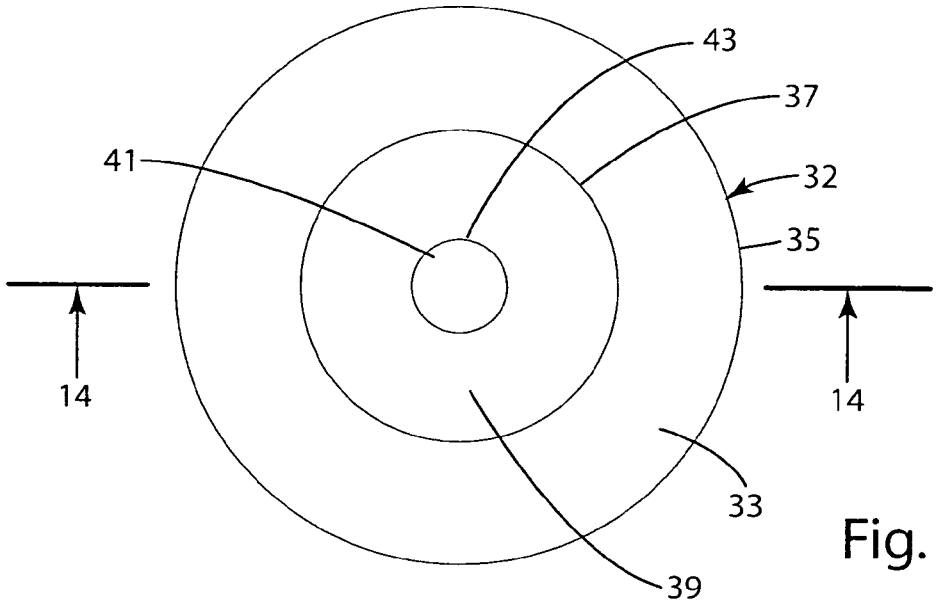
FIG. 13 is a plan view of the metal cap of the present invention.

The details of the cap pusher 120 employed in the illustrated tool embodiment are shown in FIG. 11. Cap pusher 120 comprises a plate 122 having longitudinally spaced, downwardly extending teeth 124 and 126 along one side thereof. Each of these teeth engages one cap. Thus, the cap pusher pushes two caps at once. This minimizes the stress on the tape attached to any one cap. The teeth have vertical edges on a front side and beveled edges on a rear side. The beveled edges serve as cam surfaces and permit the teeth to ride over the caps when the cap pusher is retracted. An upwardly extending flange 128 includes an opening 130 therein in which the drive shaft 141 of piston 143 is attached. A slot 132 is formed in plate 122. A resilient attachment mechanism holds the plate downwardly on the track while the plate is permitted to slide longitudinally along the track in order to push the caps into driving position. The attachment mechanism comprises a bolt 125 that fits through slot 132 and screws into a flange on the side of the track, with a spring 127 positioned between the head of the bolt and plate 122 resiliently holding the plate down (see FIG. 9). Thus, when the cap pusher is retracted, the spring lets the teeth of the cap pusher move upwardly and over the caps.

Figure 5:
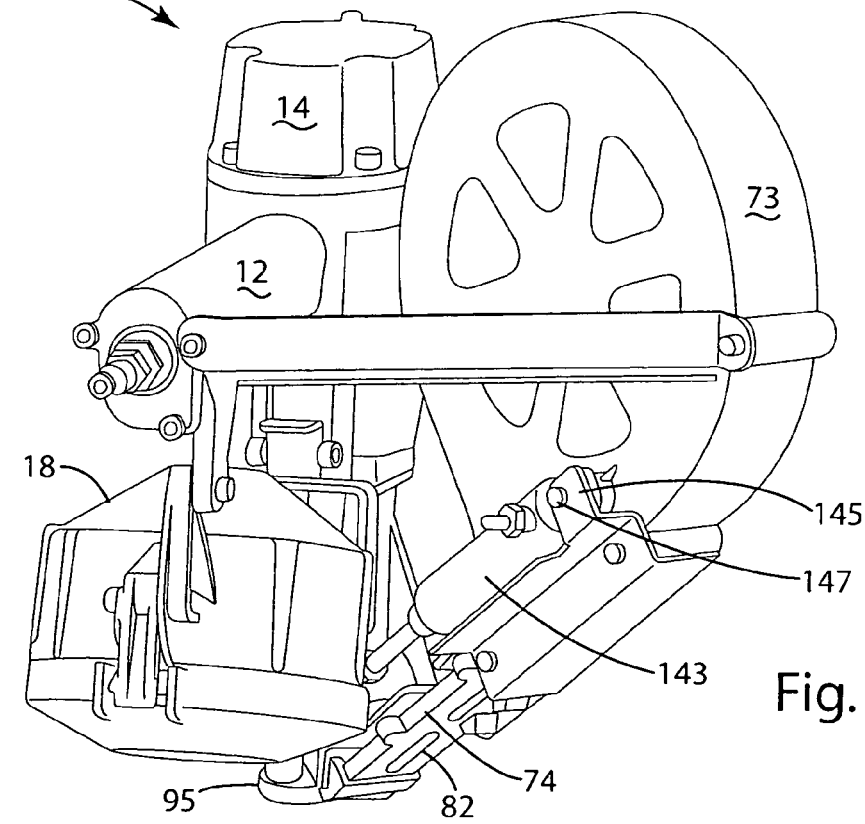
FIG. 5 is a perspective view of the tool of FIG. 4, taken from a position to the rear of the tool.
Figure 8:
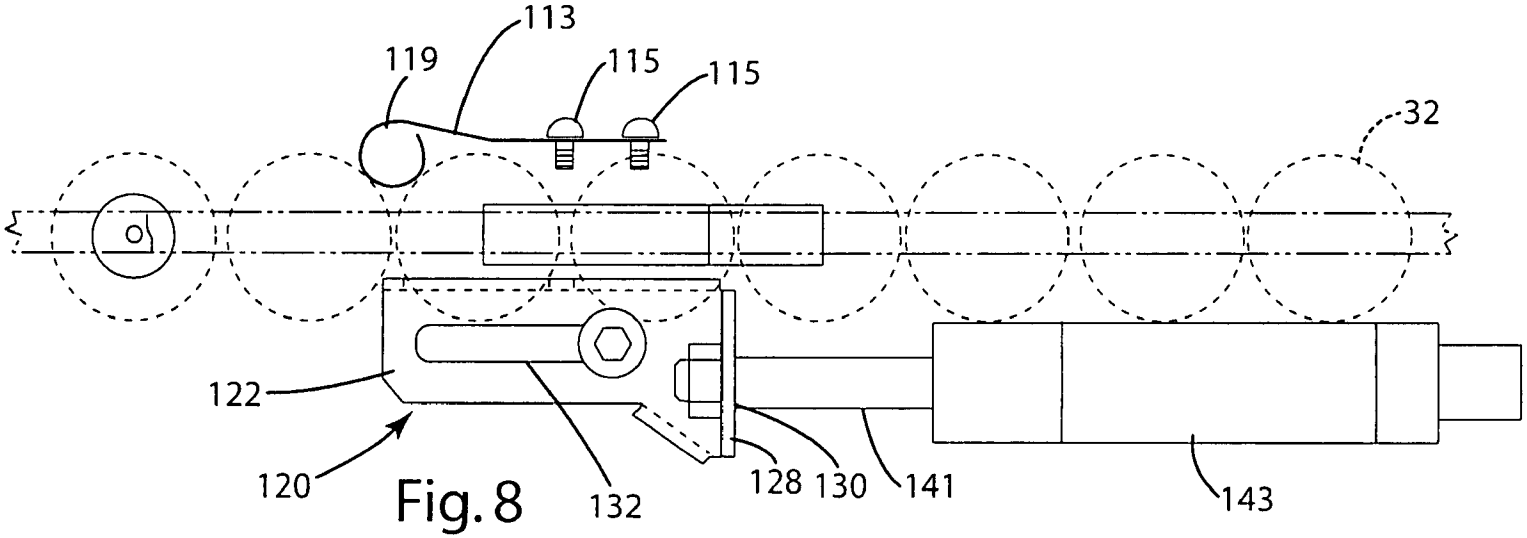
FIG. 8 is a schematic plan view showing the cap pusher or feeder mechanism employed in the tool of FIG. 4.

As shown in FIG. 5, the drive cylinder 143 for the cap pusher 120 is mounted on a vertical flange 145 by means of a trunion mount. A bolt or shaft 147 extends through an opening in a fitting at the rear of the drive cylinder and permits the drive cylinder to rotate about the bolt. Thus, when the cap pusher rocks upwardly as the cap pusher is retracted, the drive cylinder can pivot upwardly to accommodate the upward pivotal movement of the cap pusher.

Figure 14:
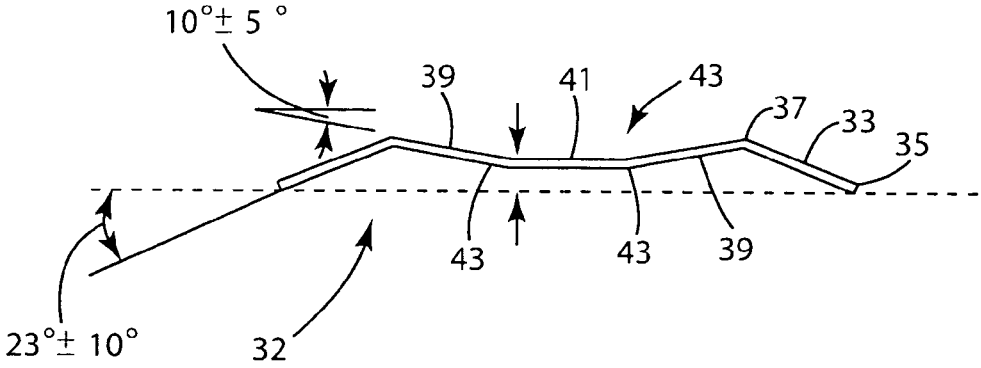
FIG. 14 is a cross sectional view taken along lines 14—14 of FIG. 13.

The cap assemblies 31 of the present invention are shown in FIGS. 3 and 11–14. The caps 32 are domed or concave disc-shaped metal caps preferably formed of a relatively thin cold rolled sheet steel. Other types of steel, such as stainless steel, or other metals, such as aluminum or copper, also can be used. The caps are stamped so that any burred edge faces up (FIG. 14 orientation). Because of the fact that the nailer cannot always be assured of striking the center of an opening in a cap, it is generally necessary to construct the metal caps so that the nails can penetrate the caps themselves without bending the fastener or jamming the tool. When this is done, it is not necessary to form a hole in the caps themselves. To make it possible for a nail to penetrate the cap without damage or malfunction, it is necessary that the caps be penetrable with a nail without bending the nail. To accomplish this, relatively soft steel having a thickness of 0.010 to 0.020 inches, preferably less than about 0.018 inches, and more preferably between 0.012 and 0.016 inches is preferred. A cap thickness of about 0.013 inches is especially preferred in the illustrated embodiment. If the cap is too thin, it bends too easily or folds. The cap is formed in a slightly domed cup-shaped configuration with a dished central portion. The center portion is spaced above the plane of the bottom of the cap.

As shown in FIG. 14, cap 32 is cup shaped with an indented or dished central portion. Cap 32 has an outer peripheral skirt 33 that extends inwardly and upwardly from outer edge 35 to upper circular ridge 37 at a desired angle of about 23°, plus or minus 10° depending on other dimensions of the cap.

Upper ridge 37 desirably is raised about 0.055 to 0.095 inches and preferably about 0.075 inches above outer edge 35. The cap has a dished inner portion 43 comprising sloped side 39 and a flat center portion 41, with a circular ridge 43 being formed at the junction of side 39 and center portion 41. Sloped side 39 extends downwardly and inwardly at an angle of about 10°, plus or minus 5°. Center portion is about 0.035 to 0.055 inches and preferably about 0.045 inches above the level of outer edge 35. The significant feature of this cap construction is that the dished center is spaced above the plane of the outer edge a sufficient distance that the cap exerts a desirable resilient clamping force on the substrate when a nail is fired through it (deflecting center portion 41 into contact with the substrate) without causing the caps to fold or "umbrella." When a cap umbrellas the cap becomes dished in the opposite direction, with the center contacting the substrate and the outer edge sloping in an upwardly and outwardly direction. In such a condition the outer edge loses its desired gripping force on the substrate.

With the cap of the present invention, ridges 37 and 43 form reinforcing convolutions in the cap. These restrain the cap from folding along a diametric line through the center of the cap and help maintain the downwardly facing cup configuration of the caps, wherein the outer edge continues to face downwardly gripping position against the substrate.

While the dimensions of the various elements of the caps can vary, the reinforcing ridges are important and it is important that the outer edge is inclined downwardly and outwardly and the inner portion is dished and positioned sufficiently above the outer edge that the outer edge maintains its shape as it is pressed resiliently against the substrate by injection of a nail through the central portion of the cap.

When the cap is formed in this way, the outer surface of the cap forms a relatively thin sharp edge. The cap is thin enough for the nail to penetrate but desirably is, at the same time, thick enough to provide sufficient resilience to provide a significant gripping force against the substrate.

The caps are connected together by a strip of adhesive paper tape 34 that is fastened to the undersides or concave sides of the caps. The tape is preferably a tape having the characteristics of masking tape, which is a paper tape covered with a pressure sensitive adhesive.

The tensile strength of the tape should be sufficient to permit the caps to be advanced along the track without the tape tearing. A tensile strength of at least two pounds is desirable and preferably at least three pounds. The tensile strength is determined by the width of the tape and the strength of the tape.

Figure 9:
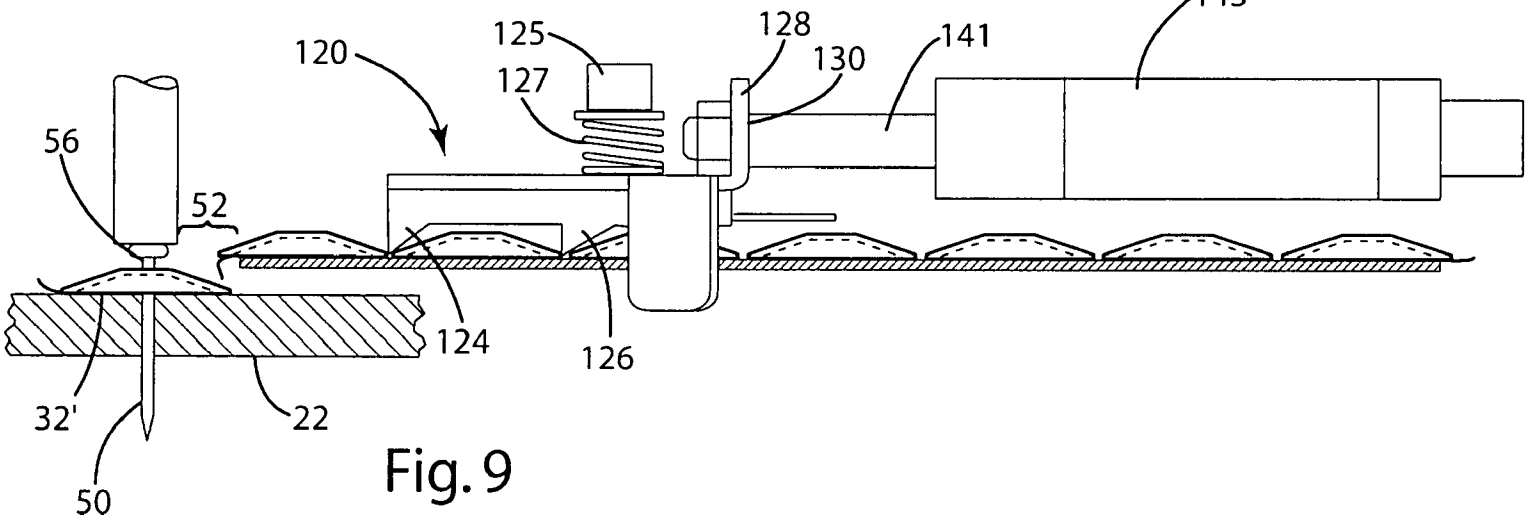
FIG. 9 is a schematic side elevational view showing the cap pusher mechanism of FIG. 8.

As shown in FIG. 9, when a cap reaches the discharge or dispensing location and a nail 50 or other fastener is driven through the cap, the cap 32' is driven downward into the substrate 22. When this occurs, the sharp outer periphery of the cap severs the tape between the caps and permits the driven cap to separate from the strip of caps and be driven downwardly into the substrate. It is not necessary in the present invention that the tape separate from the cap at all. Thus, the tape remains on the underside of the cap out of view, after the cap has been fastened to the substrate. There are therefore no remnants of severed tape sticking to the outside of the cap after the cap has been fastened to the substrate. This is an aesthetic advantage and also can provide a functional advantage, where it is undesirable to have tape sticking to the outsides of the caps.

Since the tape of the present invention has the general characteristics of masking tape, the tape does not have the high puncture resistance of a polyester tape and is not prone to tear especially easily where the tape has been torn or punctured. Instead, the tape is severable by the edges of the caps when the caps are discharged.

The pressure sensitive adhesive employed with the tape does not have to be separable from the cap, and the tape does not have to have sufficient strength to permit it to be peeled away from the cap. Thus, very sticky tape is perfectly satisfactory. Tape stuck on the undersides of the caps could even increase the cap grip on the substrate.

When caps constructed in this manner are employed in the cap feeder of the present invention, they provide an added element of versatility to the cap feeder assembly and permit it to be used under a wider range of conditions than would otherwise be possible.

Figure 15:
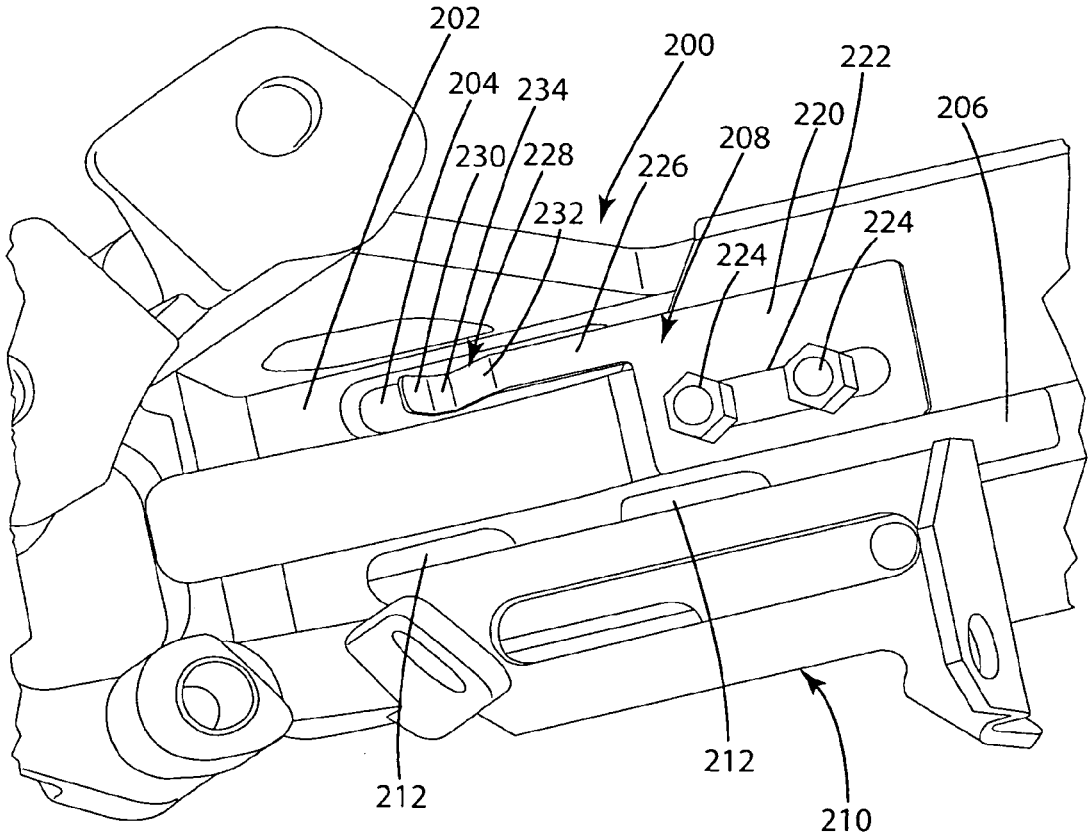
FIG. 15 is a perspective view showing the track, feeder, and cap retainer mechanism of the present invention.
Figure 16:
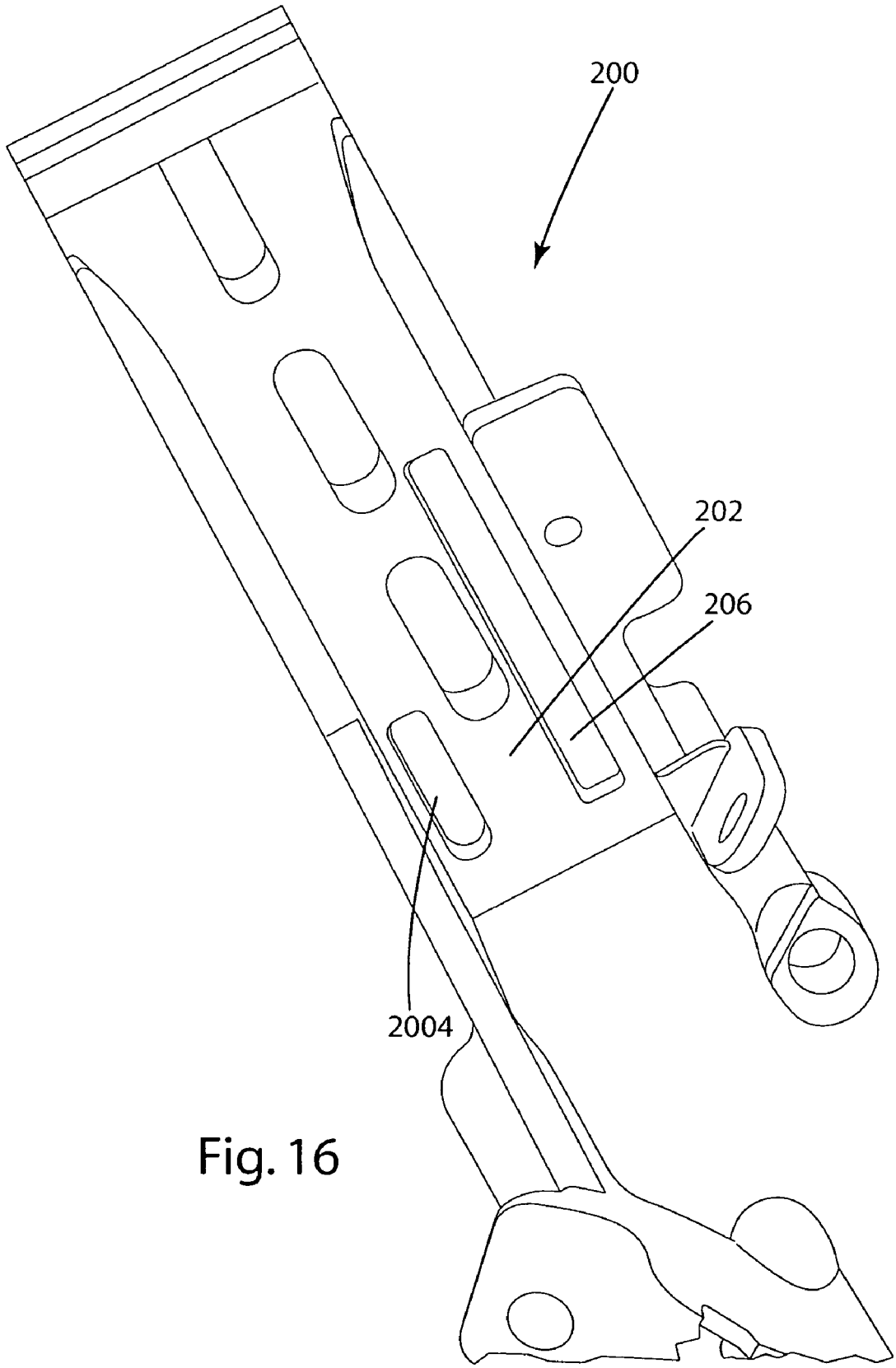
FIG. 16 is a perspective view of the track of the present invention.
Figure 17:
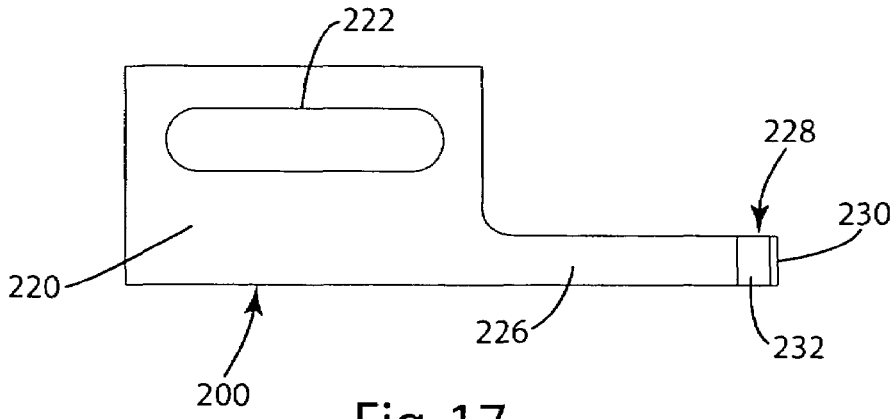
FIG. 17 is a plan view of the anti-back up pawl spring of the present invention.
Figure 18:
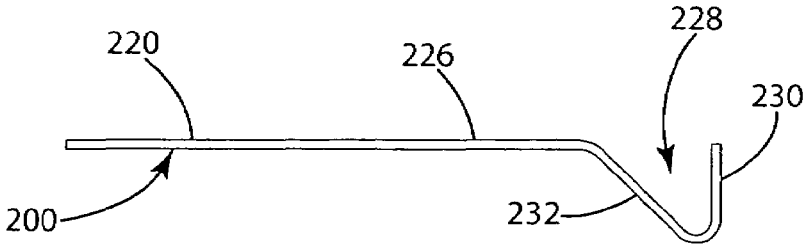
FIG. 18 is a side elevational view of the anti-back up pawl spring of the present invention.
Figure 19:
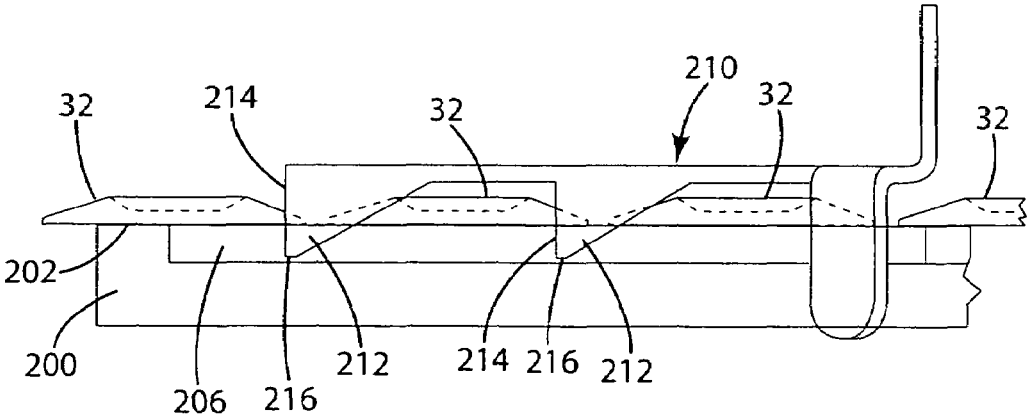
FIG. 19 is a fragmentary side elevational view showing the feeder teeth of the present invention engaged in the track.

Additional features of the cap feeder mechanism of the present invention are shown in FIGS. 15–22. An improved cap feeding mechanism is shown in FIG. 15. The improved cap feeding mechanism is designed to provide a cap feeder that can be used equally well for the metal caps of the present invention as well as plastic caps described in the previous applications. In the improved feeding mechanism, track 200 is substantially the same as track 74 with the exception that the cap supporting surface 202 is provided with elongated grooves or recesses 204 and 206 which, in the preferred embodiment are approximately 0.060 of an inch deep. Groove 204 accommodates a new anti-back up pawl spring 208 that replaces spring 186. The purpose of the recesses or grooves in the track is shown in FIG. 19. Cap pusher 210 is substantially the same as the cap pushers of the other embodiments but has slightly elongated teeth 212. The teeth fit into recess 206 so that they extend below the caps and cap support surface 202 and engage the caps on the front edge 214 at a position above the distal end 216 of the teeth. Thus, when thin caps, such as metal caps, are employed, the pusher teeth firmly engage the caps with the side edges of the teeth and the distal ends of the teeth are not inclined to slip over the caps. This mechanism works equally well with thicker plastic caps. The feeder teeth in this invention also serve to position the caps properly in their axial positions.

The pawl spring 208, shown in detail in FIGS. 17 and 18, includes a plate spring comprising a wider portion 220 having an elongated slot 222 that accommodates bolts 224. A spring arm 226 having pawl element 228 at the end extends outwardly from wider portion 220. Pawl element 228 has a substantially vertical front surface 230 and an upwardly tapered rear surface 232, which meet at a distal end 234. The distal end 234 rides in recess 204 below the plane of the lower surface of the caps, so that the front edge of the spring positively engages the caps and holds them in their proper forward position and prevents them from sliding rearwardly when the feeder mechanism retracts. The pawl spring also serves as a location device along with the teeth of the feeder.

Figure 20:
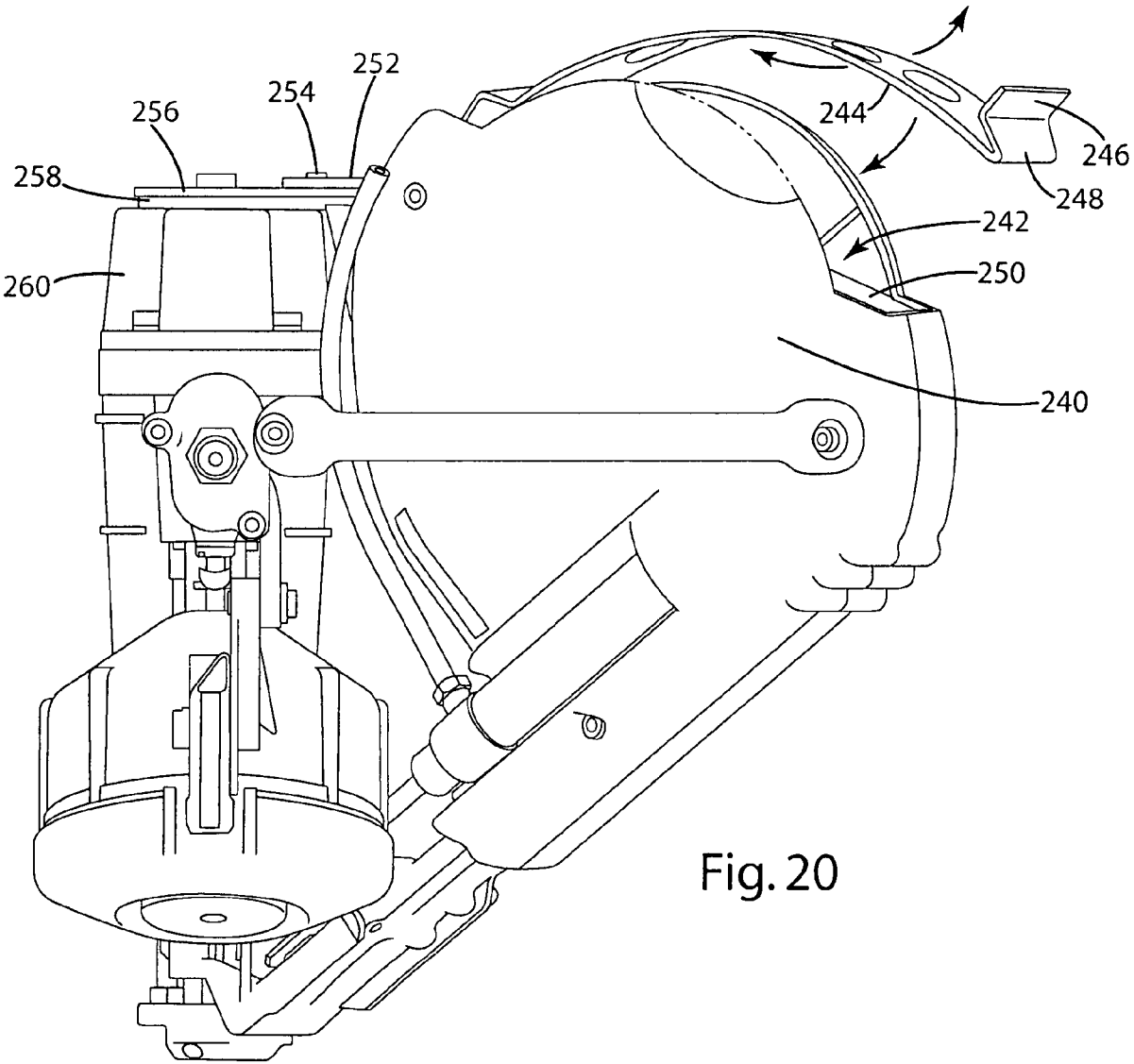
FIG. 20 is a perspective view showing the cap feeder mechanism employing an edge opening for access to the storage basket and showing a resilient cover mounted over the edge opening.
Figure 21:
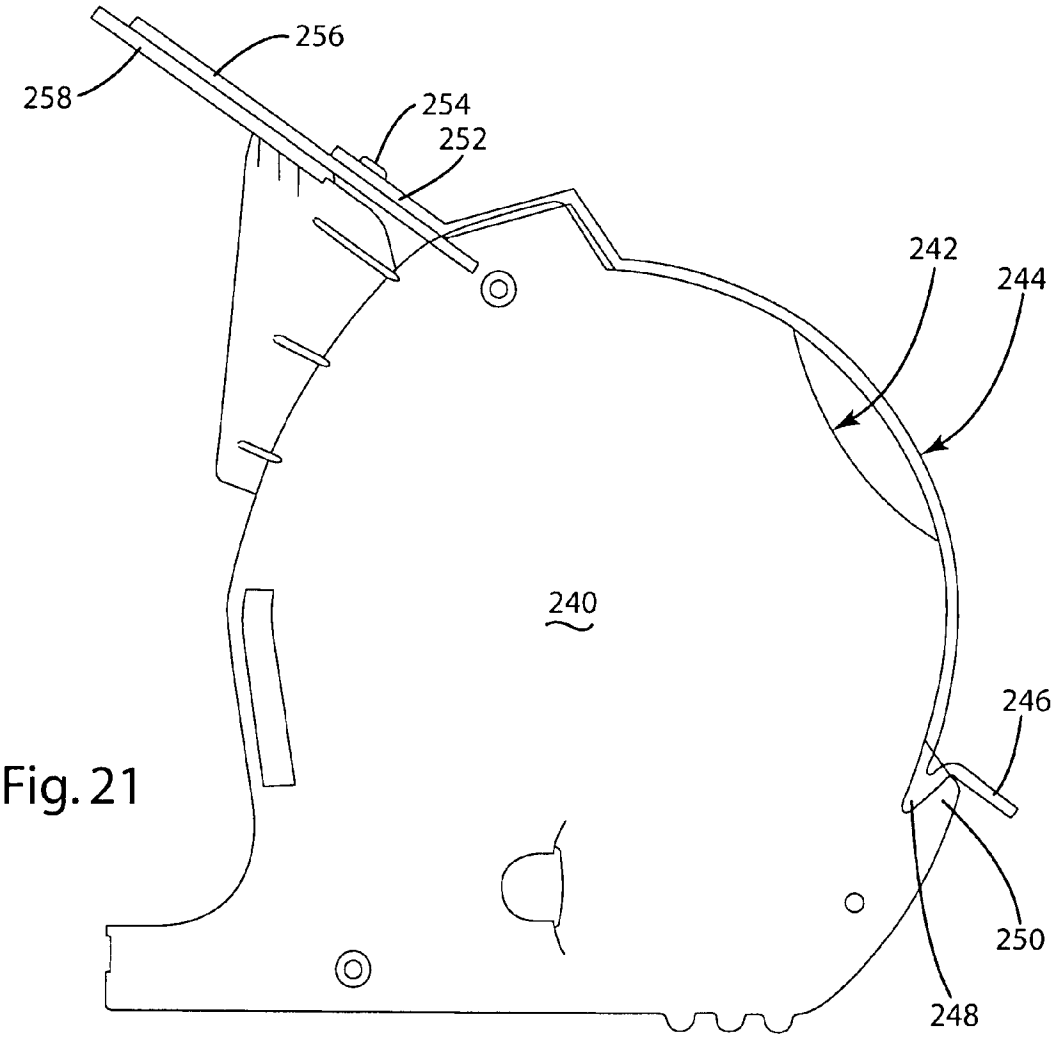
FIG. 21 is a side elevational view of the storage basket of FIG. 20.
Figure 22:
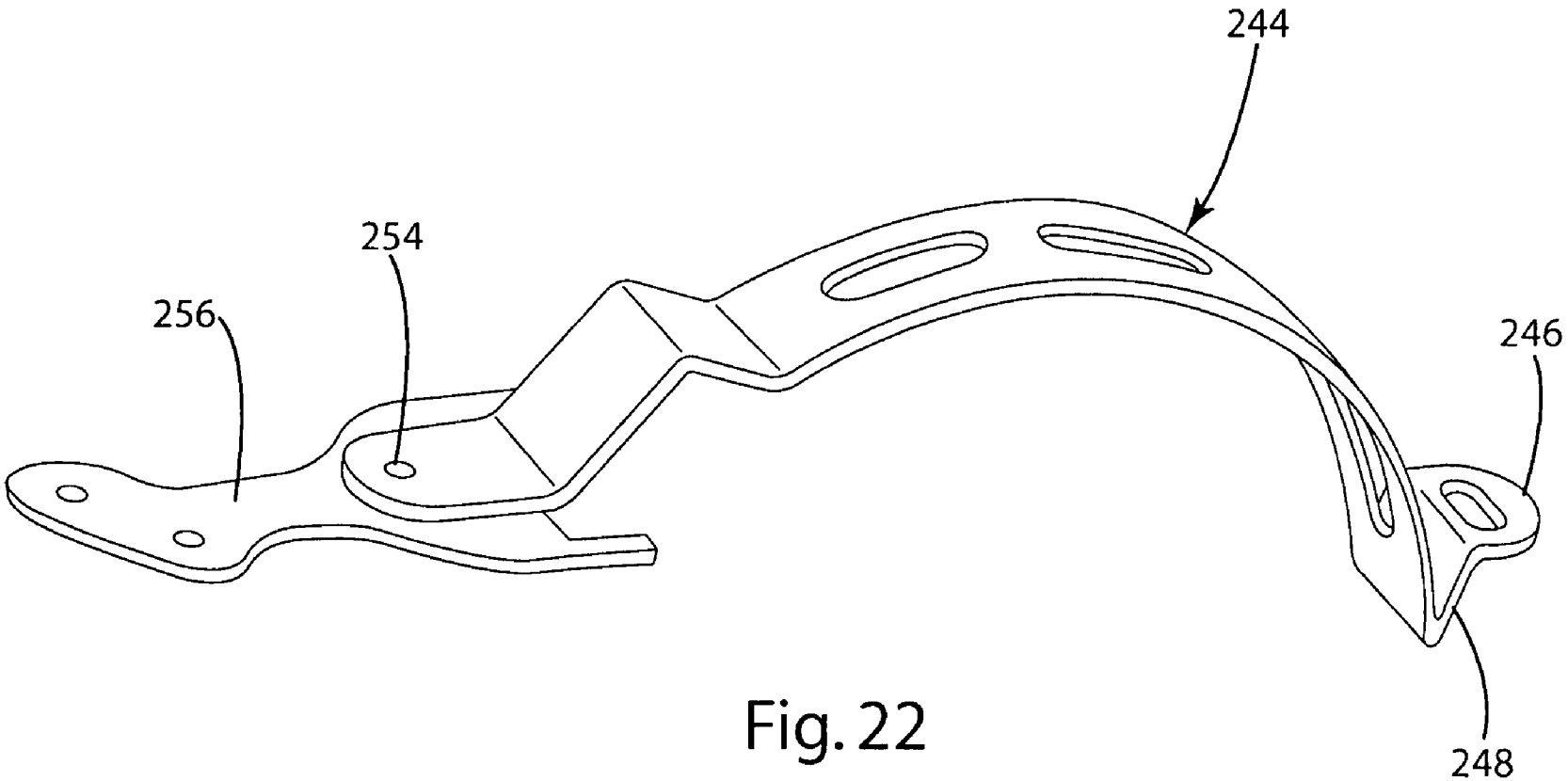
FIG. 22 is a perspective view of the cover of FIGS. 20 and 21.

Another feature of the invention is shown in FIGS. 20–22. In the preferred practice of the present invention, a cap storage basket 240 has an open edge 242 for insertion edgewise of a reel of caps. An improvement in the present invention is that a cover 244 is mounted over the open edge of the basket so as to hold the reel of caps in the basket. This prevents the caps from falling out when the fastener mechanism is used at an unusual angle.

Cover 244 is made of resilient plastic material that permits it to be opened and closed by bending the cover as shown in FIG. 20. Cover 244 includes a long arcuate strip of elastic material having a tab 246 at one end and a portion 248 that fits inside the end 250 of the edge opening in the cover. The opposite end 252 of the plastic cover is attached by a pop rivet 254 to a steel plate256 which lies flat against a flange 258 of the cap feeder mechanism. Plate 256 and 258 are bolted on the fastener driver 260, as shown in FIG. 20. The rivet holds the cover resiliently down on the open edge of the storage basket.

The cover not only can be opened by bending the cover upwardly, but the cover also can be pivoted from side to side about the axis of rivet 254 so as to swing he cover away from the open edge of the storage basket for easy access.

It should be understood that the foregoing is merely representative of the preferred practice of the present invention and that various changes and modifications may be made in the arrangements and details of construction of the embodiments described herein without departing from the spirit and scope of the present invention.

We claim:

1. A cap assembly for use with an automatic fastener driver wherein caps are fed one at a time into alignment with collated fasteners at a position wherein the fastener driver, when actuated, drives a fastener through the cap and into a substrate, the cap assembly comprising:

a plurality of the caps connected to form a strip, the strip being arranged in a coil, with the caps being dispensed from an end of the strip extending away from the coil, the caps being formed of a resilient metal of substantially uniform thickness that is thin enough that a fastener from the fastener driver will pierce the metal without jamming or injuring the driver, each cap having an upper surface with a generally convex portion and a lower surface with a generally concave portion, the caps being interconnected by a flexible adhesive tape that extends along the caps on the lower surfaces thereof, the characteristics of the tape being such that the edge of a cap severs the tape when the cap is penetrated by a fastener driven into a substrate, the tape having a tensile strength sufficient to feed the caps without breaking the tape.

2. A cap assembly according to claim 1 wherein the tape has a tensile strength of at least two pounds.

3. A cap assembly according to claim 1 wherein the tape is relatively inelastic, with the tape being severed by one of the caps as the cap is discharged and before the tape stretches substantially.

4. A cap assembly according to claim 1 wherein the caps are concave in shape, with the tape being affixed to concave inner sides of the caps.

5. A cap assembly according to claim 4 wherein convex outer sides of the caps face outwardly when the caps are oriented in a coil.

6. A cap assembly according to claim 1 wherein the caps are separated by a sufficient distance to permit the caps to be arranged in a coil with tape on the inner sides of the caps without substantial interference from edge to edge contact between adjacent caps.

7. A cap assembly according to claim 1 wherein adjacent caps are separated by about 0.050 inches when the strip of caps is flat.

8. A cap assembly according to claim 1 wherein the caps are interconnected by a strip of pressure sensitive adhesive tape having the general characteristics of masking tape.

9. A cap assembly according to claim 1 wherein the tape is narrower in width than the caps and is positioned between side edges of the caps, such that the tape is completely severed by a cap when the cap is dispensed by the fastener driver.

10. A cap assembly according to claim 1 wherein the metal caps are formed of a non-hardened steel and are no more than about 0.018 inches thick.

11. A cap assembly according to claim 10 wherein the caps do not have holes in them for receipt of fasteners.

12. A metal cap for an automatic cap feeder employed with an automatic fastener driver, the cap comprising:

a disk of metal having resilience and a generally uniform thickness, and being sufficiently thin that a fastener can be driven through the metal, the disk of metal having an upper surface, a lower surface, and a downwardly facing cup-shaped configuration, the lower surface having a generally flat central portion and an outer portion, the outer portion sloping downwardly from the central portion to a peripheral outer edge, the central portion being spaced above the plane of the peripheral outer edge of the disk such that, when the cap is fastened to a substrate by driving a fastener through the central portion of the cap, the central portion is resiliently deflected downwardly into contact with the substrate, while the outer portion of the cap maintains its downwardly facing cup-shape and is pressed resiliently against the substrate.

13. A metal cap according to claim 12 wherein the cap includes at least one circular ridge between the flat central portion and the outer peripheral edge of the cap, the ridge being an edge formed at a transition between the flat central portion and the outer portion.

14. A metal cap according to claim 13 wherein there are at least two concentric ridges in the metal disk between the central portion and outer peripheral edge.

15. A metal cap according to claim 12 wherein the central portion of the cap is positioned about 0.035 to 0.055 inches above the plane of the outer periphery of the cap.

16. A metal cap according to claim 15 wherein the central portion of the cap is positioned about 0.045 inches above the plane of the outer periphery of the cap.

17. A metal cap according to claim 12 wherein the cap is formed of a steel material that is no greater than about 0.020 inches thick.

18. A metal cap according to claim 17 wherein the metal of the cap is no greater than 0.018 inches thick.

19. A metal cap according to claim 17 wherein the metal of the cap is about 0.010 to 0.020 inches thick.

20. A metal cap according to claim 17 wherein the metal of the cap is about 0.012 to 0.016 inches thick.

21. A metal cap according to claim 20 wherein the metal of the cap is about 0.013 inches thick.

22. A metal cap according to claim 12 wherein the central portion of the cap does not have a fastener opening therethrough.

* * * * *